US005286300A

United States Patent [19]

Hnatin et al.

[11] Patent Number: 5,286,300

[45] Date of Patent: Feb. 15, 1994

[54] RINSE AID AND LUBRICANT

[75] Inventors: Michael D. Hnatin, Williamsport; David W. Reichgott, Richboro, both of Pa.

[73] Assignee: Man-Gill Chemical Company, Cleveland, Ohio

[21] Appl. No.: 928,696

[22] Filed: Aug. 12, 1992

Related U.S. Application Data

[63] Continuation of Ser. No. 654,819, Feb. 13, 1991, abandoned.

[51] Int. Cl.[5] ..... C23G 1/02; C10M 129/00; C10M 173/02

[52] U.S. Cl. ..... 134/2; 134/3; 252/49.3; 252/52 A; 72/42

[58] Field of Search ..... 252/174.02, DIG. 1, 252/DIG. 14, 135, 156, 52 A, 49.3; 72/42; 134/2, 3

[56] References Cited

U.S. PATENT DOCUMENTS

| | | | |
|---|---|---|---|
| Re. 27,662 | 6/1973 | Hamilton | 252/79.4 |
| Re. 31,349 | 8/1983 | Smith et al. | 428/623 |
| 1,814,600 | 7/1931 | Hopkins et al. . | |
| 1,978,112 | 10/1934 | Malby | 91/68 |
| 1,996,392 | 4/1935 | Torrence et al. | 91/68 |
| 2,380,166 | 7/1945 | Griffin | 252/311.5 |
| 2,673,882 | 3/1954 | Griffin | 260/615 |

(List continued on next page.)

FOREIGN PATENT DOCUMENTS

| | | |
|---|---|---|
| 648867 | 9/1962 | Canada . |
| 0137057 | 4/1985 | European Pat. Off. . |
| 53-001235 | 9/1975 | Japan . |
| 53-027636 | 3/1978 | Japan . |
| 61-227177A | 3/1985 | Japan . |
| 0235900 | 10/1985 | Japan . |
| 0785351 | 12/1980 | U.S.S.R. . |
| 901932 | 7/1962 | United Kingdom . |
| 1042263 | 9/1966 | United Kingdom . |
| 2187206A | 9/1987 | United Kingdom . |

OTHER PUBLICATIONS (BASF/Wyandotte Technical Bulletin, "The Wonderful World of Pluronic Polyols", U.S. Library of Congress, No. 70-150738, 1971).

Technical Bulletin from BASF Corporation, entitled "Performance Chemicals for Rinse Aid Formulations"](4 pages).

Technical Bulletin from BASF Corporation entitled "Rinse Aid Formulary" (no date, 4 pages).

Hachk's Chemical Dictionary, 4th Ed., Grant, McGraw-Hill Book Co., 1969, pp. 38, 332 & 540.

McCutcheon's Emulsifiers & Detergents, 1983, North American Ed., Mc Publishing Co., N.J., pp. 83, 203, 207, 236 & 250.

*Primary Examiner*—Margaret Medley

*Attorney, Agent, or Firm*—Renner, Otto, Boisselle & Sklar

[57] ABSTRACT

A composition useful as a rinse aid for metal surfaces and for improving the mobility of formed metal surfaces is described. The composition comprises (A) from about 10 to about 90% by weight of at least one nonionic polyoxyalkylene glycol comprising poly(oxypropylene) hydrophobic groups and poly(oxyethylene) hydrophilic groups, and (B) from about 10 to about 90% by weight of at least one alkoxy derivative of at least one ethoxylated and propoxylated glycol, and particularly at least one nonionic polyoxyalkylene glycol comprising poly(oxypropylene) hydrophobic groups and poly(oxyethylene) hydrophilic groups. A process is also described for improving the drainage of water from metal surfaces and for improving the mobility of formed metal surfaces. The process comprises contacting said metal surface with an aqueous composition comprising water and the above-described composition. The composition and process of the present invention result in lower oven temperatures and reduced coefficient of friction which results in improved mobility.

21 Claims, No Drawings

U.S. PATENT DOCUMENTS

| | | | |
|---|---|---|---|
| 2,674,619 | 4/1954 | Lundsted | 260/485 |
| 2,677,700 | 5/1954 | Jackson et al. | 260/488 |
| 2,856,434 | 10/1958 | Niederhauser et al. | 260/613 |
| 2,901,821 | 9/1959 | Ross | 29/495 |
| 3,082,172 | 3/1963 | Temple et al. | 252/89 |
| 3,140,203 | 7/1964 | Grunwald | 134/3 |
| 3,297,469 | 1/1967 | Otis et al. | 117/49 |
| 3,346,670 | 10/1967 | Papalos | 260/980 |
| 3,429,822 | 2/1969 | Grunewald | 252/174.22 |
| 3,457,109 | 7/1969 | Peist | 134/29 |
| 3,505,844 | 4/1970 | McLean | 72/42 |
| 3,510,430 | 5/1970 | Mickelson et al. | 252/79.1 |
| 3,597,152 | 8/1971 | Shaw | 21/217 |
| 3,635,826 | 1/1972 | Hamilton | 252/79.4 |
| 3,661,796 | 5/1972 | Erby et al. | 252/392 |
| 3,676,345 | 7/1972 | Kuceski | 252/49.3 |
| 3,728,188 | 4/1973 | Yarrington | 156/22 |
| 3,734,784 | 5/1973 | Bereday et al. | 148/6.27 |
| 3,748,177 | 7/1973 | Neumann et al. | 134/30 |
| 3,969,134 | 7/1976 | Batka et al. | 52/174.22 |
| 3,969,135 | 7/1976 | King et al. | 134/41 |
| 4,004,951 | 1/1977 | Dorsey | 148/6.27 |
| 4,009,115 | 2/1977 | Binns | 252/142 |
| 4,028,205 | 6/1977 | Dorsey | 204/181 |
| 4,042,416 | 8/1977 | Miskeck | 134/10 |
| 4,048,121 | 9/1977 | Chang | 252/174.22 |
| 4,062,312 | 12/1977 | Mason | 113/120 |
| 4,082,867 | 4/1978 | Henley et al. | 427/327 |
| 4,101,346 | 7/1978 | Dorsey | 148/6.27 |
| 4,111,722 | 9/1978 | Rechi et al. | 148/6.15 R |
| 4,116,853 | 9/1978 | Binns | 252/142 |
| 4,149,912 | 4/1979 | Craighead et al. | 148/6.3 |
| 4,157,422 | 6/1979 | Sturwald et al. | 428/457 |
| 4,172,044 | 10/1979 | Zeidler et al. | 252/142 |
| 4,177,154 | 12/1979 | Chakravarti | 252/32.5 |
| 4,178,260 | 12/1979 | Cook et al. | 252/49.8 |
| 4,228,217 | 10/1980 | Bauer | 428/409 |
| 4,239,552 | 12/1980 | Perner et al. | 134/28 |
| 4,240,921 | 12/1980 | Kaniecki | 252/174.22 |
| 4,243,537 | 1/1981 | Knepp et al. | 252/49.3 |
| 4,256,601 | 3/1981 | Sobata et al. | 252/135 |
| 4,256,602 | 3/1981 | McLaughlin | 252/142 |
| 4,270,957 | 6/1981 | Donakowski et al. | 134/2 |
| 4,348,294 | 9/1982 | King | 252/142 |
| 4,351,883 | 9/1982 | Marcantonio et al. | 428/450 |
| 4,370,173 | 1/1983 | Dollman | 134/3 |
| 4,383,898 | 5/1983 | Renton | 204/35 R |
| 4,384,965 | 5/1983 | Hellsten et al. | 252/32.5 |
| 4,435,223 | 3/1984 | Dollman | 134/3 |
| 4,445,813 | 5/1984 | Misra et al. | 413/1 |
| 4,452,711 | 6/1984 | Laemmle | 252/52 A |
| 4,452,712 | 6/1984 | Laemmle | 252/52 A |
| 4,477,290 | 10/1984 | Carroll et al. | 148/6 |
| 4,528,039 | 7/1985 | Rubin et al. | 134/2 |
| 4,540,444 | 9/1985 | Kelly | 134/3 |
| 4,560,493 | 12/1985 | Scharf et al. | 52/174.16 |
| 4,576,695 | 3/1986 | Owens | 204/181.4 |
| 4,581,152 | 4/1986 | Hotta et al. | 252/78.5 |
| 4,627,931 | 12/1986 | Malik | 252/174.22 |
| 4,637,117 | 1/1987 | Karas et al. | 29/527.4 |
| 4,647,314 | 3/1987 | Mullins et al. | 134/30 |
| 4,650,527 | 3/1987 | Ishii | 148/6.16 |
| 4,670,168 | 6/1987 | Laemmle et al. | 252/52 A |
| 4,728,456 | 3/1988 | Yameson et al. | 252/142 |
| 4,762,638 | 8/1988 | Dollman | 252/135 |
| 4,787,942 | 11/1988 | Wray | 148/6.15 |
| 4,800,034 | 1/1989 | Akao et al. | 252/565 |
| 4,828,735 | 5/1989 | Minagawa et al. | 252/52 A |
| 4,851,148 | 7/1989 | Yamasae et al. | 252/142 |
| 4,886,616 | 12/1989 | Yamasae et al. | 52/142 |
| 4,928,508 | 5/1990 | Courval | 72/42 |
| 5,061,389 | 10/1991 | Reichgott | 252/49.3 |

RINSE AID AND LUBRICANT

This is a continuation of co-pending application Ser. No. 07/654,819 filed on Feb. 13, 1991 now abandon.

FIELD OF THE INVENTION

The present invention relates to compositions which are useful as rinse aids for metal surfaces and for improving the mobility of formed metal surfaces. More particularly, the invention relates to compositions which reduce liquid residue from metal surfaces treated with aqueous solutions or rinsed with water.

BACKGROUND OF THE INVENTION

Metal cans such as aluminum cans are commonly used as containers for a wide variety of products. After the cans are formed, they are typically washed with various cleaners to remove aluminum fines and other contaminants from the surface. One undesirable result of these treatments is that water often is retained on the clean, rinsed metal cans which represents a major heat load for a dry off oven. For example, about 2.5 grams of retained water per metal can at a production rate of 2500 cans/minute represents over 200,000 kcal/hr. (8000 BTU/hr.) of energy input. Reducing the water load reduces the energy required. Additionally, faster drying may also allow an increase in production rate.

Conventional washes frequently result in a surface finish on the outside of the cans which has a deleterious effect on the efficient movement on the cans through the conveyor systems and onto or off the printer mandrels. It is important, therefore, in the can processing industry, and in particular, the aluminum can processing industry to reduce the coefficient of friction on the outside surface of the cans to improve their mobility without adversely affecting the adhesion of printing, paints or lacquers applied thereto. Cans characterized as having poor mobility generally have higher coefficients of static and kinetic friction. In the commercial can processing operation, there are numerous locations where the cans stop moving momentarily and must start again from rest. The mobility problem is particularly important when the cans are loaded on and ejected from the mandrels of high-speed printers. Other locations in the manufacturing process where the mobility problem is evident is where cans flow through the single file conveyors called "single filers". A high coefficient of static friction generally prohibits an increase in line speed, production speed and production output, results in frequent jammings and printer misfeed problems, and a general loss of production due to increased rates of damage to the cans.

A reduction in the coefficient of static friction improves can mobility through the conveyor systems, especially the single filers. A reduction in the coefficient of static friction also results in reduced printer rejects. It is therefore desirable to reduce the liquid residue remaining on cans after various aqueous treatments and to improve the mobility of the cans through the can processing equipment.

It is known to utilize various surfactants such as nonionic surfactant polyols for machine dishwashing operations. For example, a group of commercially available nonionic polyol surfactants available under the trade designation Pluronic including Pluronic L62, L43, L62D, L63, L63D, L72, L92 and L103 are reported to be rinse aids capable of providing uniformly good wetting and rapid drainage on glass surfaces thereby preventing drying lines. (BASF/Wyandotte Technical Bulletin "The Wonderful World of Pluronic Polyols", U.S. Library of Congress, No. 70-150738, 1971.) A group of rinse aid formulations suggested as being useful in commercial as well as home dishwashers are described in another Technical Bulletin from BASF Corporation, entitled "Performance Chemicals for Rinse Aid Formulations" (4 pages). This Bulletin suggests that most rinse aids contain a nonionic surfactant and one or more hydrotropes or coupling agents. Pluronic L10 surfactant is reported to be useful as a rinse aid alone with no hydrotrope. Hydrotropes are added to rinse aid liquids because nonionic surfactants are often partially insoluble in water at the desired concentrations. The hydrotropes increase the solubility of the surfactant in water. Examples of hydrotropes described in this bulletin include alkylnaphthylene sulfonates, dialkyl sulfosuccinate esters and oxyethylated straight chain alcohols. However, some nonionic hydrotropes such as propylene glycol and isopropyl alcohol, and urea are reported as generally ineffective solubilizers. The Bulletin includes a Formulations Selection Grid intended to provide a basic guide of various combinations of Pluronic materials which can be utilized in rinse aid formulations.

In another undated technical bulletin published by BASF (4 pages) entitled "Rinse Aid Formulary", rinse aid formulations are proposed for high temperature machines, low temperature machines and hard water. Formulations are also suggested which contain low actives (10 wt. percent surfactant).

U.S. Pat. No. 3,082,172 describes a defoaming rinse composition useful in machine dishwashing which contains a synthetic organic polyethenoxy nonionic surface active agent (such as Pluronic L63) and a particular polyoxyalkylene glycol mixture described as consisting of a product which statistically represented has a plurality of alternating hydrophobic and hydrophilic polyoxyalkylene chains, the hydrophilic chains consisting of oxyethylene radicals linked one to the other and the hydrophobic chains consisting of oxypropylene radicals linked one to the other. This statistical mixture is prepared generally by condensing propylene oxide with propylene glycol to form a polyoxypropylene glycol, and thereafter condensing ethylene oxide with the polyoxypropylene glycol following by condensing with propylene oxide.

U.S. Pat. No. 4,560,493 describes a liquid residue reducing composition which comprises an aqueous solution containing an effective amount of octane-1-phosphonic acid or a water-soluble salt thereof.

SUMMARY OF THE INVENTION

A composition useful as a rinse aid for metal surfaces and for improving the mobility of formed metal surfaces is described. The composition comprises (A) from about 10 to about 90% by weight of at least one nonionic polyoxyalkylene glycol comprising poly(oxypropylene) hydrophobic groups and poly(oxyethylene) hydrophilic groups, and (B) from about 10 to about 90% by weight of at least one alkoxy derivative of at least one ethoxylated and propoxylated glycol, and particularly at least one nonionic polyoxyalkylene glycol comprising poly(oxypropylene) hydrophobic groups and poly(oxyethylene) hydrophilic groups. A process is also described for improving the drainage of water from metal surfaces and for improving the mobility of formed metal surfaces. The process comprises contacting said metal surface with an aqueous composition comprising water and the above-described composition. The composition and process of the present invention result in lower oven temperatures and reduced coefficient of friction which results in improved mobility.

DESCRIPTION OF THE PREFERRED EMBODIMENTS

In one embodiment, the composition of the present invention comprises (A) from about 10 to about 90% by weight of at least one nonionic polyoxyalkylene glycol comprising poly(oxypropylene) hydrophobic groups and poly(oxyethylene) hydrophilic groups, and (B) from about 10 to about 90% by weight of at least one alkoxy derivative of at least one nonionic ethoxylated and propoxylated glycol.

The nonionic glycols of (A) and (B) comprise poly(oxypropylene) hydrophobic groups and poly(oxyethylene) hydrophilic groups. The molecular weight range of the polyoxyalkylene glycols may range from about 1100 to about 14,000 and higher. The arrangement of the hydrophobic and hydrophilic groups may be varied as desired. In one embodiment, the polyoxyalkylene glycols are formed from a hydrophobic poly(oxypropylene) group which is formed by the controlled addition of propylene oxide to the two hydroxyl groups of a propylene glycol nucleus. The length of the resulting hydrophobe can be varied as desired to provide molecular weights of from about 800 to several thousands. The hydrophobe is then reacted with ethylene oxide to form hydrophilic poly(oxyethylene) groups in controlled amounts to result in a variety of nonionic surfactants containing from 10% to 80% by weight of the hydrophilic poly(oxyethylene) groups. Nonionic polyoxyalkylene glycols of this type may be represented by the formula $$HO(CH_2CH_2O)_a(CH(CH_3)CH_2O)_b(CH_2CH_2O)_cH \quad (I)$$

wherein a and c are each independently at least 1, the sum of a+c is from 2 to about 100, and b is from about 5 to about 100. In one embodiment, b is from about 15 to about 35.

As noted above, the poly(oxyethylene) group ($CH_2CH_2O$) is a hydrophilic group whereas the poly(oxypropylene) group ($CH(CH_3)CH_2O$) is a hydrophobic group. In one embodiment of the invention, the glycol of (A) contains less than 40% of the hydrophilic group, and more often, the glycol of (A) will contain from about 5 to about 40% by weight of the hydrophilic group.

The nonionic polyoxyalkylene glycol comprising poly(oxypropylene) hydrophobic groups and poly(oxyethylene) hydrophilic groups may also be characterized by the formula $$HO(CH(CH_3)CH_2O)_a(CH_2CH_2O)_b(CH(CH_3)CH_2O)_cH \quad (II)$$

wherein a and c are each independently at least 1, the sum of a+c is from 2 to about 100, and b is from about 5 to about 100. The polyols characterized by Formula II contain a poly(oxyethylene) hydrophilic base, and such polyols can be prepared by initially reacting ethylene oxide with the two hydroxy groups of an ethylene glycol nucleus. The resulting hydrophile can be tailored to any desired length (from about 800 to several thousand in molecular weight). The hydrophile can then be reacted with propylene oxide which reacts with the hydroxyl groups of the hydrophile to form hydrophobic poly(oxypropylene) groups of controlled lengths whereby the resulting polyols contain from about 10 to about 80% by weight of the poly(oxypropylene) groups.

The ethoxylated and propoxylated glycol of (B) may be obtained by randomly reacting ethylene oxide and propylene oxide with a glycol such as ethylene glycol. The glycols of (B) may also be block copolymers of ethylene oxide and propylene oxide.

Nonionic polyoxyalkylene glycols are the type represented by Formula I are available commercially from a variety of sources including BASF Wyandotte Corporation under the general designation "Pluronic". Examples of such oxyethylated poly(oxypropylene) glycols include "Pluronic L31" wherein the polyoxypropylene hydrophobe base has a molecular weight of 950 and the base has been reacted with ethylene oxide to provide a poly(oxyethylene) hydrophile unit representing 10% of the total molecule; "Pluronic L63" wherein the polyoxypropylene hydrophobe base has a molecular weight of 1750 and has been reacted with ethylene oxide to provide a poly(oxyethylene) hydrophile unit representing 30% of the total molecule; "Pluronic L61" wherein the polyoxypropylene hydrophobe has a molecular weight of 1750 and the total molecule contains 10% of the poly(oxyethylene) hydrophile unit; "Pluronic L43" wherein the polyoxypropylene hydrophobe base has a molecular weight of about 1200, and the total molecule contains about 30% of the poly(oxyethylene) hydrophile; and "Pluronic L64" wherein the poly(oxypropylene) hydrophobe has a molecular weight of 1750, and the molecule contains about 40% by weight of the poly(oxyethylene) hydrophile.

Nonionic polyoxyalkylene glycols of the type represented by Formula I are also available from Mazer Chemicals, Inc. under the general designation Macol, and specific examples include Macol 35, Macol 42, Macol 44, Macol 46, Macol 72, etc. Examples of nonionic polyoxyalkylene glycols of the type represented by Formula II which are available from Mazer Chemicals, Inc. include Macol 31, Macol 32, Macol 33 and Macol 34. Polyoxyalkylene glycols of the type represented by Formula I also are available from Alkaril Chemicals, Ltd., a GAF company under the general trade designation Alkatronic PGP such as Alkatronic PGP 10-1, Alkatronic PGP 10-5, Alkatronic PGP 18-1, etc.

Nonionic polyoxyalkylene glycols of the type represented by Formula II are available commercially from sources such as BASF-Wyandotte Corporation under the general designation Pluronic "R". Specific examples include Pluronic 10R5, 10R8, Pluronic 17R8, Pluronic 22R4, Pluronic 31R2 and Pluronic 31R4. Polyoxyalkylene glycols of the type represented by Formula II which are available from Alkaril Chemicals, Ltd., include Alkatronic EGE 25-2 and Alkatronic EGE 33-1.

The second component present in the compositions of the present invention is (B) at least one alkoxy derivative of at least one ethoxylated and propoxylated glycol. Component (B) may be an alkoxy derivative of a glycol randomly ethoxylated and propoxylated or an alkoxy derivative of a block copolymer of propylene oxide and ethylene oxide. More particularly, (B) is at least one alkoxy derivative of at least one nonionic polyoxyalkylene glycol comprising poly(oxypropylene) hydrophobic groups and poly(oxyethylene) hydrophilic groups. In one embodiment, the alkoxy groups contain from about 3 to about 6 carbon atoms. The alkoxy derivative useful as component (B) in the compositions of the present invention may be a derivative of any of the polyoxyalkylene glycols described above as exemplifying polyalkylene glycols of (A). Thus, for example, the alkoxy derivative may be an alkoxy derivative of the nonionic polyoxyalkylene glycols of the type represented above by Formulae I and II, and any of the above-described polyoxyalkylene glycols may be converted to the alkoxy derivatives by reaction with an alkanol such as n-propanol, n-butanol, n-pentanol, n-hexanol by procedures well known to those skilled in the art. In addition, some of the alkoxy derivatives (B) are available commercially. For example, n-butoxy polyoxyethylene polyoxypropylene glycols are available from Mazer Chemicals, Inc. under the trade designations Macol 660, Macol 3520 and Macol 5100. Ucon HB 5100 is a commercially available butyl ether of a polyoxyethylene polyoxypropylene glycol containing about 50% polyoxyethylene groups.

The compositions of the present invention also comprise aqueous solutions comprising water and components (A) and (B) as described above when they are to be used as a rinse aid for metal surfaces and for improving the mobility of formed metal surfaces. The aqueous composition may be concentrates comprising from about 3 to about 45% by weight of at least one polyoxyalkylene glycol described above as component (A), from about 3 to about 45% by weight of at least one alkoxy derivative defined above as component (B) and, (C) from about 10% to 94% by weight of water. The aqueous compositions useful for treating metal surfaces in accordance with the present invention can be prepared by mixing the components in sufficient water to provide the concentrates which can then be diluted prior to use, or the aqueous composition can be prepared on diluted form by mixing (A) and (B) with an amount of water sufficient to provide the concentration desired for a working or operating solution. For example, concentrates can be prepared containing up to about 45% by weight of component (A), up to about 45% by weight of component (B) and 10% or more of water. Thereafter the concentrates can be diluted as desired.

The concentration of components (A) and (B) in the aqueous compositions useful to treat metal surfaces can be readily determined by one skilled in the art, and the concentrations will depend on such factors as the method of application including spraying, immersion, etc. Higher concentrations of components (A) and (B) may be preferred when metal surface is to be treated by spraying.

In one embodiment, aqueous operating solutions in accordance with the invention may comprise from about 0.001 to about 0.1% by weight of (A), from about 0.001 to about 0.1% by weight of (B) and water. In another embodiment the solutions may contain from about 0.002 to about 0.05% by weight of components (A) and (B). The relative amounts of (A) and (B) in the concentrates and operating solutions of the invention may range from 10:90 to 90:10 or 30:70 to 70:30. In more specific embodiments the weight ratio of (A):(B) in concentrates and operating solutions may be from about 40:60 to 60:40.

In another embodiment, the compositions (nonaqueous) of the present invention may contain up to about 50% by weight of at least one anionic organic phosphate surfactant, and the aqueous concentrates of the present invention may contain up to about 20% by weight of at least one anionic phosphate surfactant. The aqueous working solutions can contain from about 0.0001 to 0.001% by weight of an anionic phosphate ester. The free acids of anionic phosphate esters as well as the sodium and potassium salts thereof also are useful in the compositions of the present invention. Particularly useful examples of the anionic phosphate surfactants useful in the compositions of the present invention are anionic surfactants available from Rohm & Haas Company under the general trade designation "Triton". For example, Triton H-55 and H-66 are the potassium salts of anionic phosphate surfactants; and Triton QS-30 and QS-44 are examples of anionic phosphate surfactants in free acid form. Free acids of complex organic phosphate esters also are available from GAF Chemicals Corp. under the general trade designation Gafac R and specific examples of such anionic surfactants include Gafac RA-600, Gafac RM-510 and Gafac RP-710. Gafac PE-510 is another anionic surfactant comprising a free acid of a complex organic phosphate ester available from GAF.

The compositions and aqueous concentrates of the present invention also may contain up to about 2% and even up to about 5% by weight of at least one inorganic fluoride compound. The inorganic fluorides, which should be soluble in water, include alkali metal fluorides such as sodium fluoride, potassium fluoride; ammonium fluoride salts such as ammonium fluoride and ammonium bifluoride, and other inorganic fluoride salts and hydrofluoric acid. The diluted operating solutions may contain up to about 0.0005% by weight of such fluorides.

The following examples illustrate the compositions, concentrates and operating compositions of the present invention. Unless otherwise indicated in the examples and elsewhere in the specification and claims, all parts and percentages are by weight, temperatures are in degrees fahrenheit, and pressures are at or near atmospheric pressure. If a temperature is not mentioned, it is presumed to be ambient temperature.

EXAMPLE A (COMPOSITION)

| | %/Wt. |
|---|---|
| Pluronic L-61 | 50 |
| Macol 3520 | 50 |

EXAMPLE B (CONCENTRATE)

| | %/Wt. |
|---|---|
| Pluronic L-43 | 25.0 |
| Ucon HB-5100 | 25.0 |
| Deionized Water | 50.0 |

EXAMPLE C (CONCENTRATE)

| | %/Wt. |
|---|---|
| Pluronic L-43 | 18.5 |
| Ucon HB-5100 | 18.5 |
| Gafac RP-710 | 13.0 |
| Deionized Water | 50.0 |

EXAMPLE D (CONCENTRATE)

| | |
|---|---|
| Pluronic L-43 | 7.5 |
| Macol 5100 | 7.5 |
| Deionized Water | 85 |

EXAMPLE E (CONCENTRATE)

| | |
|---|---|
| Pluronic L-43 | 7.5 |
| Macol 5100 | 7.5 |
| Ammonium Fluoride (36%) | 0.2 |
| Deionized Water | 84.8 |

EXAMPLE F (OPERATING SOLUTION)

| | |
|---|---|
| Pluronic L-43 | 0.0025 |
| Ucon HB-5100 | 0.0025 |
| Water | 99.0050 |

Other operating solutions can be prepared by diluting any of the concentrates of Examples B-E to form solution containing from 0.01 to 0.25% by weight of the concentrates.

The effect of the aqueous compositions of the present invention on the drainage of water from clean, undecorated aluminum cans and the subsequent drying rate are illustrated in the following examples.

EXAMPLE 1

Aluminum cans are taken from the bodymaker of a container plant and cleaned with a commercial acidic cleaner in a laboratory spray cabinet. After rinsing with tap water, the clean wet cans are sprayed with aqueous compositions prepared from the concentrates of Examples B and C by dilution with water. The wet cans are removed from the spray cabinet in a vertical position, with the open end down so that the inverted dome (i.e., the bottom of the can) remains filled with solution. The cans are placed on a rack, and a gentle stream of air is directed downward for two seconds, thus effecting blowoff of the retained solution. The cans were then allowed to drain for 10 seconds, and the weight change of the drained can versus its subsequent weight upon drying is an indication of the weight of the water retained after blowoff. The following results are observed.

| Compositions | %/Wt. | Grams Retained Water |
|---|---|---|
| Control (water) | — | 2.69 |
| Example B | 0.01 | 2.16 |
| Example B | 0.02 | 1.97 |
| Example B | 0.03 | 1.89 |
| Example C | 0.01 | 2.01 |
| Example C | 0.02 | 2.04 |

-continued

| Compositions | %/Wt. | Grams Retained Water |
|---|---|---|
| Example C | 0.03 | 1.95 |

The above results indicate that the aqueous compositions of the present invention prepared from the concentrates of Examples B and C are effective in increasing the drainage of water and reducing the amount of retained water after blowoff. The reduction in retained water results in a reduction in the energy required for drying of the cans.

EXAMPLE 2

Aluminum cans are processes described in Example 1, but after the blowoff and drainage, the wet cans are placed in a 310° F. oven with a thermocouple in contact with the underside of the inverted dome. Temperature vs. time is recorded, and the dryoff time is taken from the inflection point of a temperature vs. time graph. The temperature in this example is about 260° F. in all cases. The drying times observed for an untreated control cans treated with the diluted concentrates of Examples B and C are summarized in the following table.

TABLE II

| Composition | %/wt. | Drying Time/sec. |
|---|---|---|
| Control (water) | — | 207 |
| Example B | 0.01 | 157 |
| Example B | 0.02 | 143 |
| Example B | 0.03 | 140 |
| Example C | 0.01 | 134 |
| Example C | 0.02 | 148 |
| Example C | 0.03 | 142 |

EXAMPLE 3

Aluminum cans are cleaned and tap water-rinsed on a pilot scale can washer. Following the tap water rinse, a deionized water rinse and a blowoff are applied, and then the cans are drawn through a 472°–484° F. oven on a conveyor. The temperature of the cans is monitored at the oven exit to indicate whether or not the cans are dry. The conveyor speed is altered until the cans exiting the oven are barely wet at a speed of 70 in/min. Can temperatures of 193°, 204°, 202° and 195° F. are observed. At this point, 0.02% of the concentrate of Example B is added to the deionized water, and the experiment is repeated. At a speed of 70 in/min. the oven exit temperatures are 278°, 288°, 283° and 253° F. indicating that the cans dried fully while still within the oven. The conveyor speed is then increased until wet cans are again produced: a speed of 98 in/min was attained. Accordingly, in commercial practice, a lower oven temperature or a faster conveyor speed can be selected while still producing dry cans when the cans are treated with the aqueous compositions of the invention.

The mobility of aluminum containers treated with the aqueous compositions of the present invention is evaluated with the following test procedure and equipment. The equipment comprises a platform which is raised through an arc of 90° to form an incline plane. The general procedure is as follows:

(1) Remove three cans from an oven and allow the cans to cool for three minutes. During this time mark one set of "looper lines" on each can;

(2) Place the cans on the platform with the "looper lines" pointing upwardly. The two base cans are placed with the open side to the right. The third can "top can" is placed above and resting on the two base cans with the open end to the left, approximately one inch from the open end of the bottom cans;

(3) Slowly elevate the platform (incline plane) until the top can slides and strikes the horizontal surface; (the angle of incline is noted and recorded);

(4) Rotate the top can 90° and repeat the process three more times; and (5) Rotate the bottom cans 180° and repeat the cycle once again.

The completed procedure produces eight data points. The test results are reported as (1) average incline (in degrees), and (2) the tangent of the average of the angle of incline which is expressed as the "coefficient of static friction" (COSF).

EXAMPLE 4

Aluminum cans are cleaned in accordance with the following procedure.

(1) Prewash containers with spray of sulfuric acid solution at a pH of 3.0, 110° F. for 30 seconds.

(2) Wash containing with spray of sulfuric acid solution containing surfactants and fluoride ions at 120° F. for 30 seconds.

(3) Tap water rinse, ambient temperature for 10 seconds.

(4) Spray with aqueous composition of invention prepared by diluting the concentrate of Example D as shown below at ambient temperature for 15 seconds.

(5) Oven dry at 150° C. for 3 minutes. The dry cans are then subjected to the mobility test described above, and the results are as follows:

| %/Wt. of Ex. D | Average Incline Plane° | Incline Plane Error | COSF |
|---|---|---|---|
| 0 | 50.8 | ±1.15 | 1.23 |
| 0.05 | 30.2 | ±1.92 | 0.58 |
| 0.10 | 26.6 | ±1.72 | 0.50 |
| 0.25 | 20.6 | ±0.75 | 0.38 |

As can be seen from the above results, aluminum cans treated with the aqueous operating solutions of the invention exhibit generally improved mobility and reduced coefficient of static friction.

The aqueous compositions and the process of the invention are applicable to a variety of metal surfaces including aluminum, steel, etc., although the compositions and process are particularly beneficial when applied to aluminum. Alloys of aluminum can be treated in accordance with the invention. Three common alloys used in the container industry are identified as aluminum alloys 3003, 3004 and 5182.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. A concentrate composition useful as a rinse aid for metal surfaces and for improving the mobility of formed metal surfaces comprising:

(A) from about 10 to about 90% by weight of at least one nonionic polyoxyalkylene glycol comprising poly(oxypropylene) hydrophobic groups and poly(oxyethylene) hydrophilic groups characterized by the formulae $$HO(CH_2CH_2O)_a(CH(CH_3)CH_2O)_b(CH_2CH_2O)_cH \quad (I)$$

$$HO(CH(CH_3)CH_2O)_a(CH_2CH_2O)_b(CH(CH_3)CH_2O)_cH \quad (II)$$

wherein a and c are each independently at least 1, the sum of a+c is from 2 to about 100 and b is from about 5 to about 100, and (B) from about 10 to about 90% by weight of at least one $C_3$ to about $C_6$ alkoxy derivative of at least one nonionic polyoxyalkylene glycol comprising random poly(oxypropylene) hydrophobic groups and poly(oxyethylene) hydrophilic groups.

2. The composition of claim 1 wherein the glycol (A) is characterized by the formula $$HO(CH_2CH_2O)_a(CH(CH_3)CH_2O)_b(CH_2CH_2O)_cH \quad (I)$$

wherein a and c are each independently at least 1, the sum of a+c is from 2 to about 100 and b is from about 5 to about 100.

3. The composition of claim 2 wherein b is from about 15 to about 35.

4. The composition of claim 1 wherein the alkoxy group of (B) is selected from the group consisting of n-propoxy, n-butoxy, n-pentoxy and n-hexyloxy.

5. The composition of claim 1 wherein the weight ratio of (A):(B) is from about 40:60 to about 60:40.

6. The composition of claim 1 wherein the glycol of (A) contains less than 40% of the hydrophilic group.

7. The composition of claim 1 wherein the glycol of (A) contains from about 5 to about 40% of the hydrophilic group.

8. The composition of claim 1 wherein the glycol of (B) contains from about 30 to about 70% by weight of the hydrophilic group.

9. The composition of claim 1 wherein the glycol (B) contains from about 45 to about 55% by weight of the hydrophilic group.

10. The composition of claim 1 wherein the alkoxy group of (B) is an n-butoxy group.

11. The composition of claim 1 also containing up to about 50% by weight of at least one anionic organic phosphate surfactant.

12. The composition of claim 1 also containing up to about 2% by weight of at least one inorganic fluoride compound.

13. An aqueous concentrate composition useful for preparing a rinse aid for metal surfaces and for improving the mobility of formed metal surfaces comprising:

(A) from about 3 to about 45% by weight of at least one polyoxyalkylene glycol comprising poly(oxypropylene) hydrophobic groups and poly(oxyethylene hydrophilic groups characterized by the formulae $$HO(CH_2CH_2O)_a(CH(CH_3)CH_2O)_b(CH_2CH_2O)_cH \quad (I)$$

$$HO(CH(CH_3)CH_2O)_a(CH_2CH_2O)_b(CH(CH_3)CH_2O)_cH \quad (II)$$

wherein a and c are each independently at least 1, the sum of a+c is from 2 to about 100 and b is from about 5 to about 100, and (B) from about 3 to about 45% by weight of at least one $C_3$ to about $C_6$ alkoxy derivative of at least one nonionic polyoxyalkylene glycol comprising random poly(oxypropylene) hydrophobic groups and poly(oxyethylene) hydrophilic groups, and (C) from about 10 to about 94% by weight of water.

14. The aqueous composition of claim 13 wherein the glycol of (A) is characterized by the formula $$HO(CH_2CH_2O)_a(CH(CH_3)CH_2O)_b(CH_2CH_2O)_cH \quad (I)$$

wherein a and c are each independently at least 1, the sum of a+c is from 2 to about 100 and b is from about 5 to about 100.

15. The composition of claim 13 wherein the alkoxy group of (B) is selected from the group consisting of n-propoxy, n-butoxy, n-pentoxy, and n-hexyloxy.

16. The composition of claim 13 wherein the weight ratio of (A):(B) is from about 40:60 to about 60:40.

17. The aqueous composition of claim 13 wherein the glycol of (A) contains from about 5% to 40% by weight of the hydrophilic groups, and the glycol of (B) contains from 40% to 60% by weight of the hydrophilic groups.

18. The aqueous composition of claim 13 wherein the alkoxy group in (B) is an n-butoxy group.

19. The aqueous composition of claim 13 also containing from about 0.1 to about 20% by weight of at least one anionic phosphate surfactant.

20. A process for improving the drainage of water from metal surfaces and improving the mobility of formed metal surfaces which comprises contacting said metal surface with an aqueous composition of comprising:

(A) from about 0.001 to about 0.1% by weight of at least one polyoxyalkylene glycol comprising poly(oxypropylene) hydrophobic groups and poly(oxyethylene) hydrophilic groups characterized by the formulae $$HO(CH_2CH_2O)_a(CH(CH_3)CH_2O)_b(CH_2CH_2O)_cH \quad (I)$$

$$HO(CH(CH_3)CH_2O)_a(CH_2CH_2O)_b(CH(CH_3)CH_2O)_cH \quad (II)$$

wherein a and c are each independently at least 1, the sum of a+c is from 2 to about 100 and b is from about 5 to about 100, and (B) from about 0.001 to about 0.1% by weight of at least one $C_3$ to about $C_6$ alkoxy derivative of at least one nonionic polyoxyalkylene glycol comprising random poly(oxypropylene) hydrophobic groups and poly(oxyethylene) hydrophilic groups, and (C) from about 99.8 to about 99.998% by weight of water.

21. A concentrate composition useful as a rinse aid for metal surfaces and for improving the mobility of formed metal surfaces consisting essentially of:

(A) at least one nonionic polyoxyalkylene glycol comprising poly(oxypropylene) hydrophobic groups and poly(oxyethylene) hydrophilic groups characterized by the formulae $$HO(CH_2CH_2O)_a(CH(CH_3)CH_2O)_b(CH_2CH_2O)_cH \quad (I)$$

$$HO(CH(CH_3)CH_2O)_a(CH_2CH_2O)_b(CH(CH_3)CH_2O)_cH \quad (II)$$

wherein a and c are each independently at least 1, the sum of a+c is from 2 to about 100 and b is from about 5 to about 100, and (B) at least one n-propoxy, n-butoxy, n-pentoxy or n-hexyloxy derivative of at least one nonionic polyoxyalkylene glycol comprising random poly(oxypropylene) hydrophobic groups and poly(oxyethylene) hydrophilic groups; wherein the weight ratio of (A):(B) is from about 40:60 to about 60:40.

* * * * *